US010332504B1

(12) United States Patent
Bastyr

(10) Patent No.: US 10,332,504 B1
(45) Date of Patent: Jun. 25, 2019

(54) NOISE MITIGATION FOR ROAD NOISE CANCELLATION SYSTEMS

(71) Applicant: Harman International Industries, Incorporated, Stamford, CT (US)

(72) Inventor: Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/205,869

(22) Filed: Nov. 30, 2018

(51) Int. Cl.
*G10K 11/178* (2006.01)

(52) U.S. Cl.
CPC ..... *G10K 11/17823* (2018.01); *G10K 2210/12821* (2013.01); *G10K 2210/3044* (2013.01)

(58) Field of Classification Search
None
See application file for complete search history.

(56) References Cited

U.S. PATENT DOCUMENTS

2005/0053244 A1* 3/2005 Onishi ..... G10K 11/17883 381/71.11
2011/0261970 A1* 10/2011 Hamelink ..... G10K 15/02 381/71.4
2015/0356966 A1* 12/2015 Yano ..... G10K 11/178 381/71.8
2016/0012815 A1* 1/2016 Yano ..... G10K 11/17833 381/71.11
2017/0032806 A1* 2/2017 Konjeti ..... G10L 15/20

* cited by examiner

*Primary Examiner* — Paul W Huber
(74) *Attorney, Agent, or Firm* — Brooks Kushman P.C.

(57) ABSTRACT

A road noise cancellation (RNC) system may include a noise controller for detecting non-stationary events, such as objects striking vibration sensors, based on sensor signals having a spectral character significantly different from steady-state road noise. Upon detection of an object strike, the RNC system may be deactivated or certain speakers may be muted. Alternatively, the RNC system may modify the sensor signals to mask the non-stationary event, thereby preventing the RNC system from generating anti-noise based on the object strike.

20 Claims, 4 Drawing Sheets

NOISE MITIGATION FOR ROAD NOISE CANCELLATION SYSTEMS

TECHNICAL FIELD

The present disclosure is directed to road noise cancellation and, more particularly, to mitigating the effects of non-stationary events such as object strikes on accelerometers in a road noise cancellation system.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, combine to reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at the typical location of one or more listeners' ears. Cancelling such road noise results in a more pleasurable ride for vehicle passengers, and it enables vehicle manufacturers to use lightweight materials, thereby decreasing energy consumption and reducing emissions.

RNC systems are typically Least Mean Square (LMS) adaptive feed-forward systems that continuously adapt W-filters based on both acceleration inputs from the vibration sensors located in various positions around a vehicle's suspension system, subframe and body, and on signals of microphones located in various positions inside the vehicle's cabin. RNC systems are susceptible to spurious noises from the sensors adding to the total noise within the passenger cabin. Because RNC systems are typically feed-forward systems, the vibration sensor outputs are equalized by the LMS W-filters and are then amplified and sent directly to the speakers, where they become airborne anti-noise signals. Accordingly, all signals output by the vibration sensors (typically accelerometers) are radiated into the passenger cabin, where they are heard by the vehicle occupants. This also means any spurious, impulsive noises sensed by the accelerometers are amplified and radiated into the passenger cabin where they become audible to the vehicle passengers. In vehicles with RNC, when a rock directly strikes an accelerometer, a high amplitude signal is output from the accelerometer's one or more directional output channels, which is then filtered by a W-filter, amplified, and radiated into the passenger cabin. This creates an additional loud impulsive noise, rather than creating a quieter interior noise level.

SUMMARY

Various aspects of the present disclosure relate to preventing or mitigating the extremely loud and impulsive noise in the passenger cabin that results from rocks striking vibration sensors (e.g., accelerometers) attached to the underbody of vehicles with road noise cancellation (RNC). Several detection and mitigation systems and/or methods are disclosed that prevent this impulsive noise from being radiated into the passenger cabin thereby disturbing the passengers.

In one or more illustrative embodiments, a method for mitigating the effects of non-stationary events in a road noise cancellation (RNC) system is provided. The method may include receiving a noise signal from a vibration sensor and generating an anti-noise signal based in part on the noise signal, the anti-noise signal to be radiated by a speaker as anti-noise within a cabin of a vehicle. The method may also include detecting an occurrence of an object strike to the vibration sensor based on a parameter computed from samples of a frame of the noise signal and modifying the anti-noise signal to reduce an effect of the occurrence of the object strike on the anti-noise.

Implementations may include one or more of the following features. The parameter computed from samples of the frame of the noise signal may be one of an amplitude of the frame and an energy value of the frame. Detecting an occurrence of an object strike to the vibration sensor may include: comparing the parameter of a current frame of the noise signal to a threshold and detecting the occurrence of the object strike to the vibration sensor when the parameter exceeds the threshold. Comparing the parameter of a current frame of the noise signal to a threshold may include: transforming the current frame to the frequency domain; calculating a level of one or more frequency ranges in the current frame; and comparing the level to the threshold. The threshold may be a predetermined static threshold programmed for the RNC system. The threshold may be a dynamic threshold computed from a statistical analysis of the parameter computed from samples in one or more preceding frames of the noise signal. For instance, the threshold may be an average value of the parameter taken from multiple preceding frames multiplied by a gain factor.

Moreover, detecting an occurrence of an object strike to the vibration sensor may include: comparing the parameter from a current frame to an average value of a same parameter from one or more previous frames and detecting the occurrence of the object strike to the vibration sensor when a difference between the parameter from the current frame and the average value from the one or more previous frames exceeds a threshold. Modifying an anti-noise signal to be radiated by a speaker as anti-noise may include deactivating the RNC system so no anti-noise signal is generated for a duration of the frame. Modifying an anti-noise signal to be radiated by a speaker as anti-noise may include zeroing the frame of the noise signal containing the parameter indicative of the object strike to generate an adjusted noise signal of approximately zero for the frame. Modifying an anti-noise signal to be radiated by a speaker as anti-noise may include replacing the frame of the noise signal containing the parameter indicative of the object strike with a previous frame from the noise signal.

One or more additional embodiments may be directed to an RNC system including a vibration sensor adapted to generate a noise signal in response to vibrational input and a noise controller. The noise controller may include a processor and memory programmed to: detect an occurrence of an object striking the vibration sensor based on a parameter computed from samples of a current frame of the noise signal; and generate an adjusted noise signal in response to detecting the occurrence of an object striking the vibration sensor.

Implementations may include one or more of the following features. The RNC system may further include a controllable filter configured to generate an anti-noise signal based on the adjusted noise signal and an adaptive transfer characteristic. The RNC system may also include an adaptive filter controller, including a processor and memory, programmed to control the adaptive transfer characteristic of the controllable filter based on a filtered noise signal and an error signal received from a microphone located in a cabin of a vehicle. The RNC system may also include a loudspeaker adapted to radiate anti-noise within the cabin of the vehicle in response to receiving the anti-noise signal. The adjusted noise signal may be generated by one of zeroing the current frame of the noise signal containing the parameter indicative of the object strike or replacing the current frame of the noise signal containing the parameter indicative of the object strike with a previous frame from the noise signal.

One or more additional embodiments may be directed to a computer-program product embodied in a non-transitory computer readable medium that is programmed for road noise cancellation (RNC). The computer-program product may include instructions for: analyzing noise signals received from at least one vibration sensor; detecting an occurrence of an object strike to the at least one vibration sensor based on a parameter computed from samples of a frame of at least one noise signal; and modifying an anti-noise signal to be radiated by a speaker as anti-noise within a cabin of a vehicle in response to detecting the occurrence of the object strike, the anti-noise signal being based in part on the at least one noise signal.

Implementations may include one or more of the following features. The computer-program product where the instructions for detecting an occurrence of an object strike to the at least one vibration sensor may include: comparing the parameter of a current frame of the noise signal to a threshold and detecting the occurrence of the object strike to the vibration sensor when the parameter exceeds the threshold. The computer-program product where the instructions for detecting an occurrence of an object strike to the at least one vibration sensor may include: comparing the parameter from a current frame to an average value of the same parameter from one or more previous frames and detecting the occurrence of the object strike to the at least one vibration sensor when a difference between the parameter from the current frame and the average value from the one or more previous frames exceeds a threshold. The computer-program product where the instructions for modifying an anti-noise signal may include deactivating the RNC system so no anti-noise signal is generated for a duration of the frame. The computer-program product where the instructions for modifying an anti-noise signal may include zeroing the frame of the noise signal containing the parameter indicative of the object strike to generate an adjusted noise signal of approximately zero for the frame. The computer-program product where the instructions for modifying an anti-noise signal may include replacing the frame of the noise signal containing the parameter indicative of the object strike with a previous frame from the noise signal.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
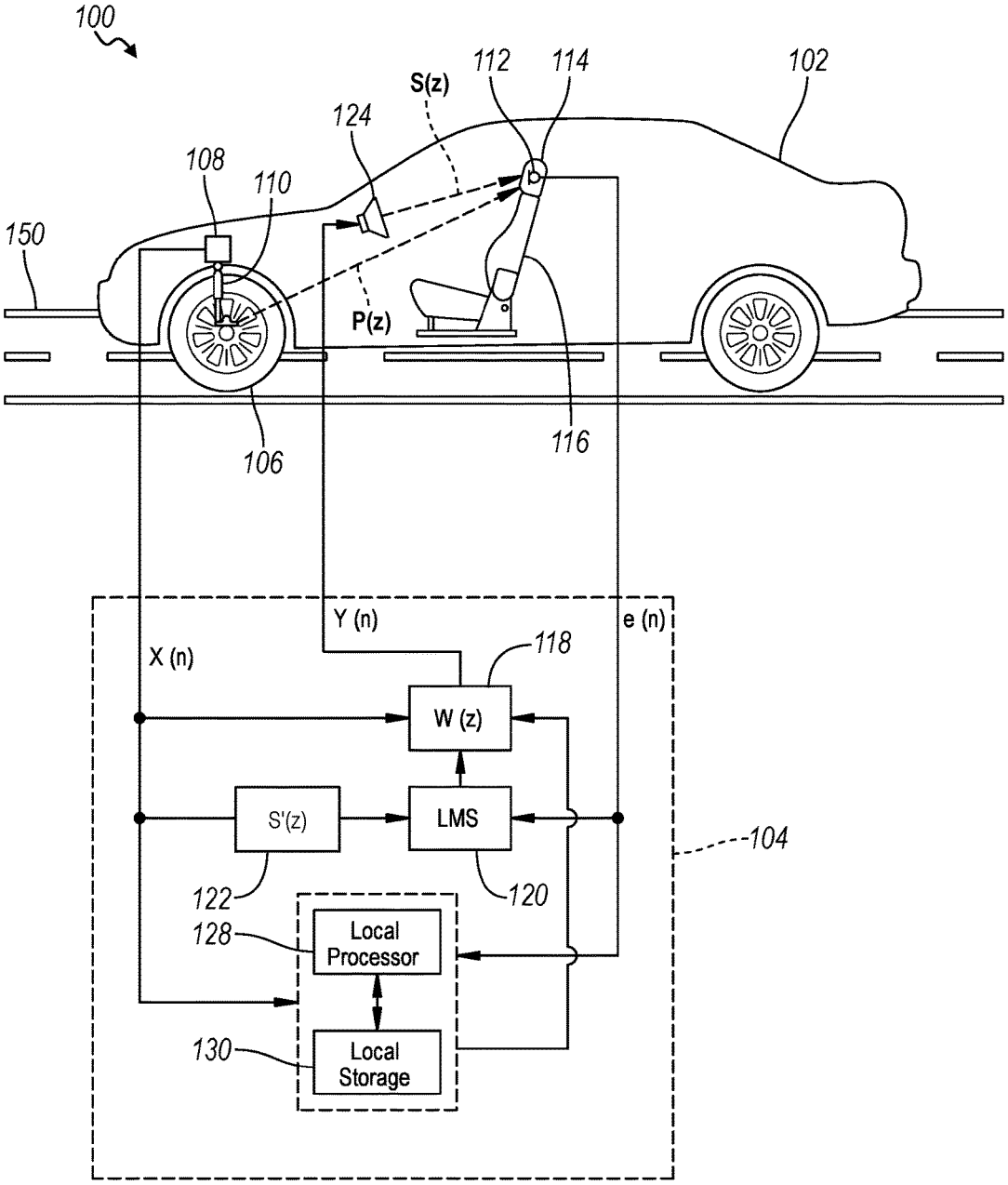
FIG. 1 is a block diagram of a vehicle having a road noise cancellation (RNC) system, in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension and subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), microphones 112 (e.g., 4 to 6), and speakers 124 (e.g., 4 to 8).

The vibration sensors 108 may include, but are not limited to, accelerometers, force gauges, geophones, linear variable differential transformers, strain gauges, and load cells. Accelerometers, for example, are devices whose output voltage is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those skilled in the art. In certain embodiments, a microphone may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e., the transfer function between an actual noise source and an error microphone).

The microphone 112 may output an error signal e(n) representing the noise present in the cabin of the vehicle 102 as detected by the microphone 112. In the RNC system 100, an adaptive transfer characteristic W(z) of a controllable filter 118 may be controlled by adaptive filter controller 120. The adaptive filter controller 120 may operate according to a known least mean square (LMS) algorithm based on the error signal e(n) and the noise signal X(n), which is optionally filtered with the modeled transfer characteristic S'(z) by the secondary path filter 122. The controllable filter 118 is often referred to as a W-filter. An anti-noise signal Y(n) may be generated by an adaptive filter formed by the controllable filter 118 and the adaptive filter controller 120 based on the identified transfer characteristic W(z) and the vibration signal, or a combination of vibration signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels at this location.

While the vehicle 102 is under operation, a processor 128 may collect and optionally processes the data from the vibration sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, accelerometer or microphone spectra or time dependent signals, other acceleration characteristics including spectral and time dependent properties. In addition, the processor 128 may analyze the vibration sensor data and extract key features to determine a set of key parameters to be applied to the RNC system 100. The set of key parameters may be selected when triggered by an event. In one or more embodiments, the processor 128 and storage 130 may be integrated with one or more RNC system controllers, such as the adaptive filter controller 120.

As previously described, typical RNC systems may use several vibration sensors, microphones and speakers to sense structure-borne vibratory behavior of a vehicle and generate anti-noise. The vibration sensors may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors. Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., secondary path filters 122), which estimate the transfer function for each secondary path. As shown in FIG. 1, an RNC system will also have one W(z) filter (i.e., controllable filter 118) between each noise signal X(n) from a vibration sensor (i.e., accelerometer) 108 and each speaker 124. Accordingly, a 12-accelerometer signal, 6-speaker RNC system may have 72 W(z) filters. The relationship between the number of accelerometer signals, speakers, and W(z) filters is illustrated in FIG. 2.

Figure 2:
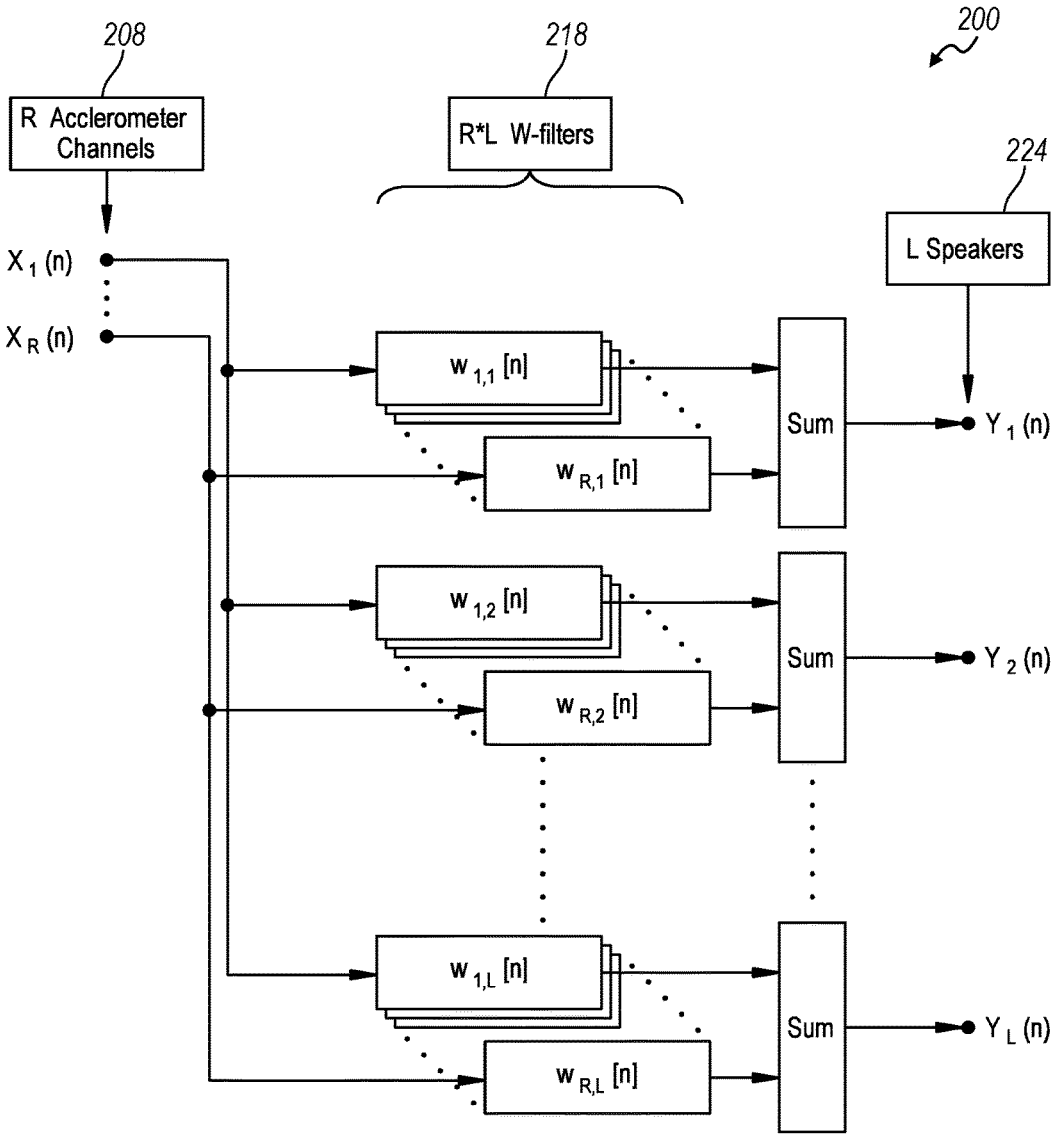
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals $[X_1(n), X_2(n), \ldots X_R(n)]$ from accelerometers 208 and L anti-noise speaker signals $[Y_1(n), Y_2(n), \ldots Y_L(n)]$ for speakers 224. Accordingly, the RNC system 200 may include R*L controllable filters (or W-filters) 218 between each of the accelerometer signals and each of the speakers. As an example, an RNC system having 12 accelerometer outputs (i.e., R=12) may employ 6 dual-axis accelerometers or 4 triaxial accelerometers. In the same example, a vehicle having 6 speakers (i.e., L=6) for reproducing anti-noise, therefore, may use 72 W-filters in total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

In vehicles with RNC, when an object such as a rock directly strikes the accelerometer, a high amplitude signal is output from one or more of the accelerometer X-, Y-, and Z-direction output channels, which is then amplified and radiated into the passenger cabin. Because very little airborne or structure born noise caused by the rock striking the accelerometer actually enters the passenger cabin, this anti-noise does not lead to noise cancellation, but rather it may lead to an additional extremely loud impulsive noise in the passenger cabin. In contrast, when a vehicle drives over an impulsive feature in the road, such as a railroad track or a pothole, some airborne or structure born noise enters the passenger cabin. With RNC deactivated, a vehicle driving over a railroad track creates noise that can be heard inside the passenger cabin, while an object striking an accelerometer will not typically create a loud sound within the passenger cabin. Therefore, with RNC activated, radiating anti-noise into the passenger cabin based on the object strike may have the effect of creating more noise within the passenger cabin. The RNC systems described in the present disclosure can reduce the frequency of, or eliminate, the radiation of nonstationary anti-noise into the passenger cabin by detecting such spurious events as object strikes and modifying the resultant anti-noise signal.

To detect a non-stationary event, such as an object directly striking one of the accelerometers, the noise signal(s) X(n) output from one or multiple accelerometers in the RNC system may be evaluated. The noise signal X(n) of each accelerometer channel may be an analog or digital signal. Evaluation of the time history of these output signals may identify object strikes when they occur. For instance, a rock strike will cause an extremely high amplitude (i.e., possibly full scale), short duration pulse to appear in an accelerometer output signal. It is likely that this high amplitude, short-duration signal will appear on more than one of the X-, Y-, and Z-direction output channels of the accelerometer. It is also unlikely that two accelerometers in the RNC system will experience simultaneous rock strikes, making detection of rock strikes easier.

Figure 3A:
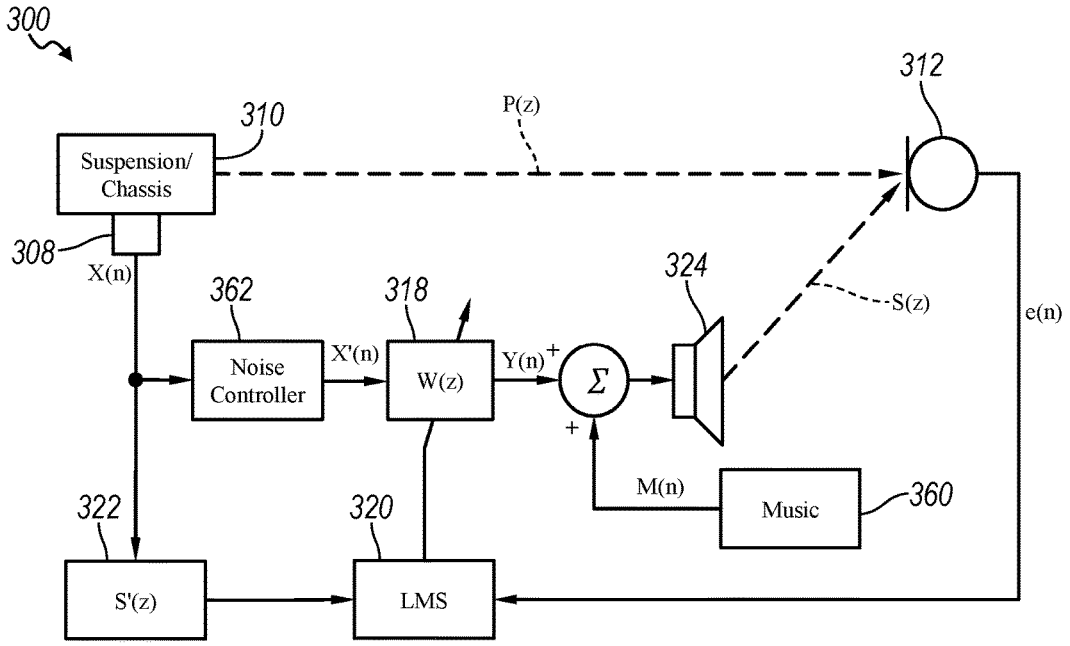
FIG. 3*a* is a schematic block diagram representing an RNC system including a non-stationary noise controller, in accordance with one or more embodiments of the present disclosure.

FIG. 3*a* is a schematic block diagram representing an RNC system 300, in accordance with one or more embodiments of the present disclosure. Similar to RNC system 100, the RNC system 300 may include elements 308, 310, 312, 318, 320, 322, and 324 consistent with operation of elements 108, 110, 112, 118, 120, 122, and 124, respectively, discussed above. In one or more embodiments, a music signal M(n) from a music playback device 360, such as the head unit (not shown) may be combined with the anti-noise signal Y(n) to be amplified and sent to the speaker 324. FIG. 3*a* also shows the primary path P(z) and secondary path S(z), as described with respect to FIG. 1, in block form. As shown, the RNC system 300 may further include a non-stationary noise controller 362 disposed along the path between the vibration sensor 308 and the controllable filter 318. The noise controller 362 may include a processor and memory (not shown) programmed to detect an object striking the vibration sensor 308 based on the noise signal X(n). This may include computing parameters by analyzing samples from a frame of the noise signal X(n).

In response to detecting an object strike, the noise controller 362 may generate an adjusted noise signal X'(n). Accordingly, the controllable filter 318 may be configured to generate the anti-noise signal Y(n) based on the adjusted noise signal X'(n) and the adaptive transfer characteristic W(z) as controlled by the LMS adaptive filter controller 320. The adjusted noise signal X'(n) may modify the anti-noise signal Y(n) to be radiated by the speaker 324 as anti-noise in a manner that reduces the effect of the object strike on the anti-noise. If no object strike is detected, the noise controller 362 may not adjust the noise signal X(n) such that the noise signal X(n) may be passed through to the controllable filter 318. As will be described in greater detail, the adjusted noise signal X'(n) may be generated by zeroing the frame of the noise signal X(n) containing the parameter indicative of the object strike to provide an output of approximately zero for the frame. As an alternative, the adjusted noise signal X'(n) may be generated by replacing the frame of the noise signal X(n) containing the parameter indicative of the object strike with a previous frame from the noise signal.

Figure 3B:
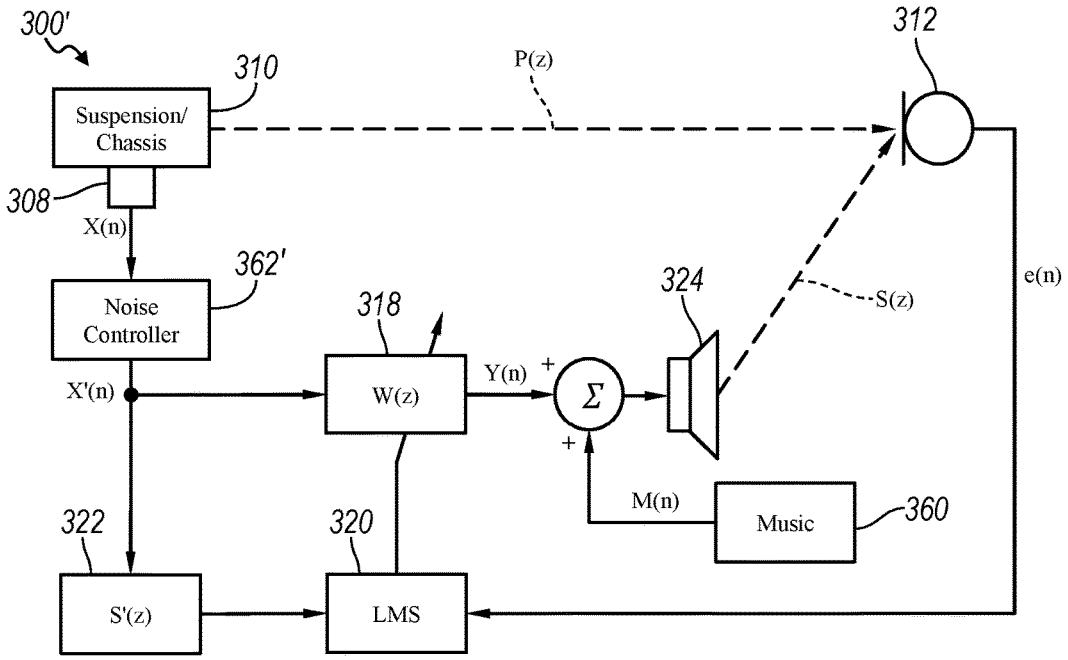
FIG. 3*b* is an alternative schematic block diagram representing the RNC system from FIG. 3*a*.

The noise controller 362 may be a dedicated controller for detecting non-stationary signals, such as those induced by object strikes, or may be integrated with another controller or processor in the RNC system, such as the LMS controller 320. Alternatively, the noise controller 362 may be integrated into another controller or processor within vehicle 102 that is separate from the other components in the RNC system. In an alternate embodiment, as shown in FIG. 3*b*, a noise controller 362' may be disposed along the path between the vibration sensor 308 and both the controllable filter 318 and secondary path filter 322 such that the secondary path filter also receives the adjusted noise signal X'(n).

Figure 4:
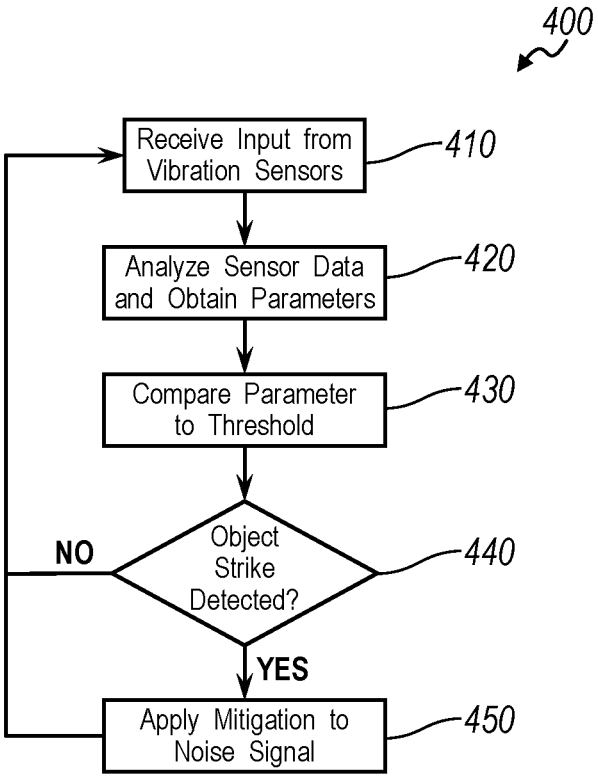
FIG. 4 is a flowchart depicting a method for mitigating the effects of non-stationary events, such as a rock strike, in an RNC system, in accordance with one or more embodiments of the present disclosure.

FIG. 4 is a flowchart depicting a method 400 for mitigating the effects of non-stationary events, such as a rock strike, in an RNC system. Various steps of the disclosed method may be carried out by the noise controller 362, either alone, or in conjunction with other components of the RNC system.

At step 410, the RNC system 300 may receive noise signals X(n) from at least one vibration sensor 308. To this end, a group of samples of time data from an output channel of a vibration sensor 308 may be received by the noise controller 362. The group of samples of time data may form one digital signal processing (DSP) frame. In an embodiment, 128 time samples of the output from the vibration sensor may form a single DSP frame. In alternate embodiments, greater or fewer time samples may compose a single frame.

At step 420, an analysis of the sensor data within a frame may be performed. In various embodiments, this analysis may include calculating, extracting or otherwise obtaining one or more parameters from each frame of sensor data sampled from the noise signal X(n). In an example, the noise controller 362 may calculate the fast Fourier transform (FFT) of the frame to form a frequency domain representation of the sensed vibrational input from the vibration sensor 308. The analysis may further include evaluating the FFT in one or multiple frequency ranges, or in individual frequency bins. For instance, a rock strike to a vibration sensor is a short duration impulse, which in the frequency domain is a very broadband signal. Thus, the acceleration character of a rock strike in the frequency domain is quite different than the acceleration character of the road in steady-state. Obtaining and analyzing a parameter from the frame such as a level of one or more frequency ranges may therefore enable detection of a non-stationary object strike event. In other examples, the analysis could also include computing parameters such as the total energy within the DSP frame or the peak or highest amplitude of all the time samples within the frame. Because the amplitude of the acceleration signal created by a rock or other object striking on or near a vibration sensor (such as an accelerometer) is of much higher amplitude than the acceleration signal created by traversing a predominant road surface, analyzing these parameters may also enable detection.

Step 420 may also include storing the parameter(s) or sensor data of a current frame for use in analyzing future frames of sensor data. In an embodiment, the parameter(s) or sensor data from the frame immediately prior to a current frame may be stored. In another embodiment, a statistical analysis may be performed on the parameters obtained from multiple prior frames of sensor data (e.g., to determine a threshold). For instance, a short- or long-term average of a parameter obtained from multiple preceding frames may be calculated and stored as its own parameter for use in step 430, either as a threshold or to obtain a difference from the current frame for comparison to a threshold. In certain of these embodiments, a predetermined gain margin may be added to the average value (or other statistical value) calculated from multiple preceding frames to form a threshold. This may include adding a gain margin of 20%, 50% or 100% to the average value or other statistical value. Thus, the average value from multiple preceding frames may be multiplied by a gain factor (e.g., 120%, 150%, 200%, etc,) to obtain the threshold. In other embodiments, other gain factors are possible. In another embodiment, a threshold may be calculated using data from other vibration sensors in the RNC system using any combination of the aforementioned threshold-deriving techniques. Additionally, a threshold may be derived by analyzing the current frame of sensor data from any, or combinations of any, noise signals from other vibration sensors.

At step 430, the parameter computed from the current frame of sensor data may be compared directly to a corresponding threshold. If the parameter from the current frame exceeds the threshold, the noise controller 362 may conclude a non-stationary event such as the occurrence of an object strike has been detected. If the parameter from the current frame does not exceed the threshold, the noise controller 362 may conclude that no object strike has been detected. For instance, the noise controller 362 may compute the energy in the current frame or a peak amplitude of the current frame and compare the energy value or peak amplitude to a corresponding threshold to determine whether an object strike has occurred.

Alternatively, the parameter computed from the current frame of sensor data may be may be compared to a statistical value (e.g., average value) of the same parameter from one or more previous frames of sensor data obtained from either the same noise signal, one or more noise signals from other vibration sensors, or any combination thereof, as previously described. The difference between the current frame's parameter and the statistical value may then be compared to a threshold. If the difference exceeds the threshold, the noise controller 362 may conclude an object strike has been detected. If the difference does not exceed the threshold, the noise controller 362 may conclude that no object strike has been detected. For example, in an embodiment, the noise controller 362 may compute the energy in the current frame and compare it to the energy in a previous frame, noting that any difference exceeding a predetermined threshold may be indicative of an object strike. In another embodiment, the FFT of a current frame of the noise signal output from a vibration sensor may be calculated and compared to the FFT of the previous frame, noting that a change on the level of one or more FFT bins beyond a predetermined threshold may also be indicative of a non-stationary signal, such as a rock strike.

In one or more embodiments, the threshold may be a predetermined static threshold set and programmed by trained engineers during the tuning of the RNC system and its corresponding algorithms. In alternate embodiments, the threshold may be a dynamic threshold computed from a statistical analysis of the parameter obtained in one or more preceding frames as discussed above with regard to step 420. For instance, the threshold may be a short- or long-term average value of a parameter taken from multiple preceding frames. Moreover, the average value may be enhanced by a gain factor, as previously discussed, to establish the dynamic threshold. In yet another embodiment, the threshold may simply be the value of the parameter from the previous frame of time data, which may also be multiplied by a gain factor.

The noise controller 362 may also apply temporal thresholding in conjunction with the aforementioned variants of amplitude thresholding at step 430. For example, some nonstationary events such as rock strikes induce a high amplitude output signal with a duration of 1 to 2 ms. Thus, temporal thresholding may further aid in the detection of nonstationary events such as rock strikes. For instance, when the amplitude of samples in the current frame exceeds an amplitude threshold for less than a predetermined temporal threshold, a rock strike may be detected. If the amplitude of samples in the current frame exceeds an amplitude threshold for more than a predetermined threshold, a nonstationary event such as the vehicle driving over a pothole may be detected.

Referring to step 440, when a non-stationary event such as the occurrence of an object strike is detected, the method may proceed to step 450 in which mitigating measures may be applied to the noise signal to minimize the current frame's influence in generating anti-noise. However, when the occurrence of an object strike is not detected, the method may skip any mitigation and return to step 410 so the process can repeat with a new frame of sensor data.

At step 450, the mitigation may be applied to the frame of sensor data. One mitigation technique may be to simply deactivate or mute RNC for the duration of the current DSP frame, resulting in the lack of anti-noise output signals Y(n) to some or all the speakers 324 in the RNC system 300. In certain embodiments, it may be possible to mute certain speakers that have medium to high amplitude controllable filters 318 for the particular noise signal X(n).

Because RNC systems typically have multiple feedforward vibration sensors, there are response options that are not available to simpler ANC systems, such as those employed in headphones. For example, if the frame containing the object strike or other nonstationary event is simply zeroed, then no anti-noise related to this impulsive event will be radiated into the passenger cabin. Likewise, if this were an ANC headphone, then no anti-noise at all would be present during that frame. This may lead to an undesirable impression that ANC momentarily turned off (for the duration of that frame) and then resumed after the frame. The sudden discontinuity at the beginning or end of the DSP frame could also create the impression of undesirable pops and clicks coming from the speaker. Methods of temporal smoothing known to those skilled in the art of DSP may be applied to the samples at the start and the end of the current frame of data to prevent this. Alternately, smoothing or changes to the sample values just preceding or just following the current DSP frame can be made to prevent the audible pops and clicks. It is possible to replace the current frame of data with a signal that has near zero amplitude to eliminate or reduce audible pops and clocks at the beginning and/or end of the frame. In an embodiment, the data in the current frame can be replaced by samples that contain the averaged values of one or more previous frames that also eliminate or reduce audible pops and clicks.

The RNC system 300 may not exhibit this same undesirable behavior if a current frame of the feed-forward noise signal X(n) from one vibration sensor is zeroed. This is because the anti-noise radiated from each speaker 324 is made up of signals from multiple vibration sensor outputs. For instance, in an RNC system that employs 6 dual-axis accelerometers or 4 triaxial accelerometers, there will be 12 accelerometer output X(n) signals. In the case of 6 dual-axis accelerometers, zeroing the current frame containing parameters indicative of an object strike would result in the reduction accelerometer signals used in creating the total anti-noise radiated from a particular speaker from 12 to 10. Thus, this may result in the decrease in anti-noise amplitude of 1.5 dB (i.e., 10/12), as compared to the complete muting of anti-noise to the speaker or to all the speakers for the duration of the frame.

In certain embodiments, more sophisticated mitigation solutions are possible, wherein only during the duration of the object strike, or nonstationary event, is the acceleration signal zeroed. This may further shorten the duration of the reduced anti-noise, which, in turn, may further mask the rock strike or nonstationary event. Other mitigation techniques are possible, such as repeating the last frame of the output noise signal from the vibration sensor, rather than zeroing it. In various embodiments, any aforementioned mitigation technique, or combinations of techniques, may be accompanied by a reduced playback level during all or a portion of the current frame. This may be accomplished by reducing any, or combinations of any, W(z) filter amplitude, or by additional attenuation blocks (not shown) that reduce the level of one or more X'(n) or Y(n).

Thus, in response to detecting a non-stationary event, such as the occurrence of an object strike, based on a parameter computed from samples of a frame of a noise signal X(n), the resultant anti-noise signal Y(n) may be modified to reduce an effect of the occurrence the object strike on the anti-noise to be radiated in the cabin of a vehicle. The anti-noise signal may be modified in various ways, as discussed above, including deactivating or muting the RNC system for the duration of the event or DSP frame. Alternatively, the anti-noise signal Y(n) may be modified by generating an adjusted noise signal X'(n), for example, by zeroing the frame of the noise signal X(n) containing the parameter indicative of the object strike to provide an output of approximately zero for the frame or by replacing the frame of the noise signal X(n) with a previous frame from the noise signal.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure.

Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for mitigating the effects of non-stationary events in a road noise cancellation (RNC) system, the method comprising:

receiving a noise signal from a sensor;

generating an anti-noise signal based in part on the noise signal, the anti-noise signal to be radiated by a speaker as anti-noise within a cabin of a vehicle;

detecting an occurrence of an object strike to the sensor based on a parameter computed from samples of a frame of the noise signal; and modifying the anti-noise signal to reduce an effect of the occurrence of the object strike on the anti-noise.

2. The method of claim 1, wherein the parameter computed from samples of the frame of the noise signal is one of a peak amplitude of the frame, an average amplitude of the frame, and an energy value of the frame.

3. The method of claim 1, wherein detecting an occurrence of an object strike to the sensor comprises:

comparing the parameter of a current frame of the noise signal to a threshold; and detecting the occurrence of the object strike to the sensor when the parameter exceeds the threshold.

4. The method of claim 3, wherein comparing the parameter of a current frame of the noise signal to a threshold comprises:

transforming the current frame to the frequency domain;

calculating a level of one or more frequency ranges in the current frame; and comparing the level to the threshold.

5. The method of claim 3, wherein the threshold is a predetermined static threshold programmed for the RNC system.

6. The method of claim 3, wherein the threshold is dynamic threshold computed from a statistical analysis of the parameter computed from samples in one or more preceding frames of the noise signal.

7. The method of claim 6, wherein the threshold is an average value of the parameter taken from multiple preceding frames multiplied by a gain factor.

8. The method of claim 1, wherein detecting an occurrence of an object strike to the sensor comprises:

comparing the parameter from a current frame to an average value of a same parameter from one or more previous frames; and detecting the occurrence of the object strike to the sensor when a difference between the parameter from the current frame and the average value from the one or more previous frames exceeds a threshold.

9. The method of claim 1, wherein modifying an anti-noise signal to be radiated by a speaker as anti-noise comprises deactivating the RNC system so no anti-noise signal is generated for a duration of the frame.

10. The method of claim 1, wherein modifying an anti-noise signal to be radiated by a speaker as anti-noise comprises zeroing the frame of the noise signal containing the parameter indicative of the object strike to generate an adjusted noise signal of approximately zero for at least a portion of the frame.

11. The method of claim 1, wherein modifying an anti-noise signal to be radiated by a speaker as anti-noise comprises replacing the frame of the noise signal containing the parameter indicative of the object strike with a previous frame from the noise signal.

12. A road noise cancellation (RNC) system comprising:

a sensor adapted to generate a noise signal in response to one of an acoustical or vibrational input; and a noise controller, including a processor and memory, programmed to:

detect an occurrence of an object striking the sensor based on a parameter computed from samples of a current frame of the noise signal; and generate an adjusted noise signal in response to detecting the occurrence of an object striking the sensor.

13. The RNC system of claim 12, further comprising:

a controllable filter configured to generate an anti-noise signal based on the adjusted noise signal and an adaptive transfer characteristic;

an adaptive filter controller, including a processor and memory, programmed to control the adaptive transfer characteristic of the controllable filter based on a filtered noise signal and an error signal received from a microphone located in a cabin of a vehicle; and a loudspeaker adapted to radiate anti-noise within the cabin of the vehicle in response to receiving the anti-noise signal.

14. The RNC system of claim 12, wherein adjusted noise signal is generated by one of zeroing the current frame of the noise signal containing the parameter indicative of the object strike or replacing the current frame of the noise signal containing the parameter indicative of the object strike with a previous frame from the noise signal.

15. A computer-program product embodied in a non-transitory computer readable medium that is programmed for road noise cancellation (RNC), the computer-program product comprising instructions for:

analyzing noise signals received from at least one sensor;

detecting an occurrence of an object strike to the at least one sensor based on a parameter computed from samples of a frame of at least one noise signal; and modifying an anti-noise signal to be radiated a speaker as anti-noise within a cabin of a vehicle in response to detecting the occurrence of the object strike, the anti-noise signal being based in part on the at least one noise signal.

16. The computer-program product of claim 15, wherein the instructions for detecting an occurrence of an object strike to the at least one sensor comprises:

comparing the parameter of a current frame of the noise signal to a threshold; and detecting the occurrence of the object strike to the sensor when the parameter exceeds the threshold.

17. The computer-program product of claim 15, wherein the instructions for detecting an occurrence of an object strike to the at least one sensor comprises:

comparing the parameter from a current frame to an average value of the same parameter from one or more previous frames; and detecting the occurrence of the object strike to the at least one sensor when a difference between the parameter from the current frame and the average value from the one or more previous frames exceeds a threshold.

18. The computer-program product of claim 15, wherein the instructions for modifying an anti-noise signal include deactivating the RNC system so no anti-noise signal is generated for a duration of the frame.

19. The computer-program product of claim 15, wherein the instructions for modifying an anti-noise signal include zeroing the frame of the noise signal containing the parameter indicative of the object strike to generate an adjusted noise signal of approximately zero for the frame.

20. The computer-program product of claim 15, wherein the instructions for modifying an anti-noise signal include replacing the frame of the noise signal containing the parameter indicative of the object strike with a previous frame from the noise signal.

* * * * *